US005876207A

United States Patent [19]

Sundius et al.

[11] Patent Number: 5,876,207

[45] Date of Patent: Mar. 2, 1999

[54] PRESSURE-SENSING TOOTHBRUSH

[75] Inventors: Carole L. Sundius, Londonderry, N.H.; Brendan P. McFadden, Brockton, Mass.

[73] Assignee: Gillette Canada Inc., Kirkland, Canada

[21] Appl. No.: 868,369

[22] Filed: Jun. 3, 1997

[51] Int. Cl.[6] ..... A46B 9/04

[52] U.S. Cl. ..... 433/216; 15/105; 15/167.1

[58] Field of Search ..... 15/105, 167.1, 15/22.1; 433/216

[56] References Cited

U.S. PATENT DOCUMENTS

| | | |
|---|---|---|
| 2,319,205 | 5/1943 | Buck . |
| 3,512,202 | 5/1970 | Taylor . |
| 4,192,035 | 3/1980 | Kuris . |
| 4,253,212 | 3/1981 | Fujita . |
| 4,340,069 | 7/1982 | Yeaple . |
| 4,450,599 | 5/1984 | Scheller et al. . |
| 4,476,604 | 10/1984 | White et al. . |
| 4,506,400 | 3/1985 | Klein . |
| 4,633,542 | 1/1987 | Taravel . |
| 4,680,825 | 7/1987 | White et al. . |
| 4,698,869 | 10/1987 | Mierau et al. . |
| 4,716,614 | 1/1988 | Jones et al. . |
| 4,788,734 | 12/1988 | Bauer . |
| 4,944,296 | 7/1990 | Suyama . |
| 5,105,499 | 4/1992 | Dirksing . |
| 5,138,733 | 8/1992 | Bock . |
| 5,146,645 | 9/1992 | Dirksing . |
| 5,165,131 | 11/1992 | Staar . |
| 5,282,291 | 2/1994 | Spieler et al. . |
| 5,315,732 | 5/1994 | Huefner et al. . |
| 5,323,504 | 6/1994 | McCusker . |
| 5,331,707 | 7/1994 | Irizarry . |
| 5,355,544 | 10/1994 | Dirksing . |
| 5,412,827 | 5/1995 | Muller et al. . |
| 5,454,133 | 10/1995 | Garnet . |
| 5,493,747 | 2/1996 | Inakagata et al. . |

FOREIGN PATENT DOCUMENTS

| | | |
|---|---|---|
| 2004029 | 5/1990 | Canada . |
| 0 481 553 A1 | 4/1992 | European Pat. Off. . |
| 40 12 413 A1 | 10/1991 | Germany . |
| 3-173558 | 7/1991 | Japan . |
| 5-154015 | 6/1993 | Japan . |
| 609 238 A5 | 2/1979 | Switzerland . |

OTHER PUBLICATIONS

AMP Connections, "Duplicating Nature But Sensing the Difference".

*Primary Examiner*—Randall E. Chin
*Attorney, Agent, or Firm*—Fish & Richardson P.C.

[57] ABSTRACT

A toothbrush including a head, a tuft of bristles positioned at the head, a piezoelectric film disposed within the head in such a way that a force applied to the tuft of bristles generates voltage in the piezoelectric film, and an indicator for indicating that a predetermined level of voltage is being generated in the piezoelectric film. Preferably the tuft of bristles is able to "float" within the head of the toothbrush. The indicator is constructed to provide a signal that is perceivable by a user of the toothbrush (e.g., a visible signal or an audible signal).

24 Claims, 4 Drawing Sheets

PRESSURE-SENSING TOOTHBRUSH

BACKGROUND OF THE INVENTION

The present invention relates to pressure-sensing toothbrushes for sensing the pressure applied during brushing of oral surfaces.

The main cause of caries and marginal gingivitis is the formation of dental plaque. This soft adhering coating on the teeth results from the accumulation of bacteria and remnants of food, which build up preferentially at the edges of the gums. Toothbrushing has long been used for oral hygiene. While toothbrushing is generally effective in cleaning the tooth surfaces, its effectiveness is greatly decreased if the duration of brushing or force applied during brushing is inadequate. Vigorous brushing of the teeth with excessive force, however, can cause damage to tooth material and to gum tissue. Both the velocity with which the teeth are brushed and the pressure applied during brushing contribute to root surface abrasion and gingival recession.

Accordingly, there is a need to indicate to the user of a toothbrush the brushing pressure applied, brushing velocity, and, especially for children, when brushing has been performed for the proper duration.

SUMMARY OF THE INVENTION

The invention features a toothbrush that emits a signal, e.g., light or sound, when the amount of pressure being applied by the toothbrush exceeds a predetermined value, e.g., a value corresponding to a safe brushing pressure. The pleasant sounds or intriguing visual displays emitted by the present invention can provide incentive to children to continue brushing. The signal can also provide information as to the amount of pressure being applied during brushing, which can help more mature users regulate their brushing technique.

In a first aspect, the invention features a toothbrush including a head, a tuft of bristles positioned at the head, a piezoelectric film disposed within the head in such a way that a force applied to the tuft of bristles generates voltage in the piezoelectric film, and an indicator for indicating that a predetermined level of voltage is being generated in the piezoelectric film. Preferably the indicator is constructed to provide a signal that is perceivable by a user of the toothbrush (e.g., a visible signal or an audible signal).

In one embodiment, the piezoelectric film is disposed beneath the tuft of bristles.

Preferably the tuft of bristles is capable of retracting axially into the head when a force is applied to the tuft of bristles. The head preferably further includes an opening through which the tuft of bristles is axially moveable.

In one preferred embodiment, the toothbrush further includes a membrane disposed beneath the tuft of bristles for inhibiting axial movement of the tuft of bristles through the opening in the head in the absence of a force being applied to the tuft of bristles. The membrane may be disposed between the tuft of bristles and the piezoelectric film. Preferably the membrane is resiliently deformable and capable of spot deformation.

The toothbrush preferably further includes a cavity located within the head so as to permit movement of the tuft of bristles into the head. In preferred embodiments, the membrane extends across the cavity.

The indicator of the toothbrush preferably includes a comparator device for comparing the predetermined level of voltage with the voltage generated in the piezoelectric film, and a signal element (e.g., a light emitting diode or a musical integrated circuit) responsive to the comparator device for signaling when the voltage generated in the piezoelectric film is greater than the predetermined level of voltage.

In another aspect, the invention features a method for cleaning an oral surface. The method includes brushing an oral surface with the above-described toothbrush.

Other features and advantages of the invention will be apparent from the description of preferred embodiments thereof, taken together with the drawings, and from the claims.

DESCRIPTION OF THE PREFERRED EMBODIMENTS

Figure 1:
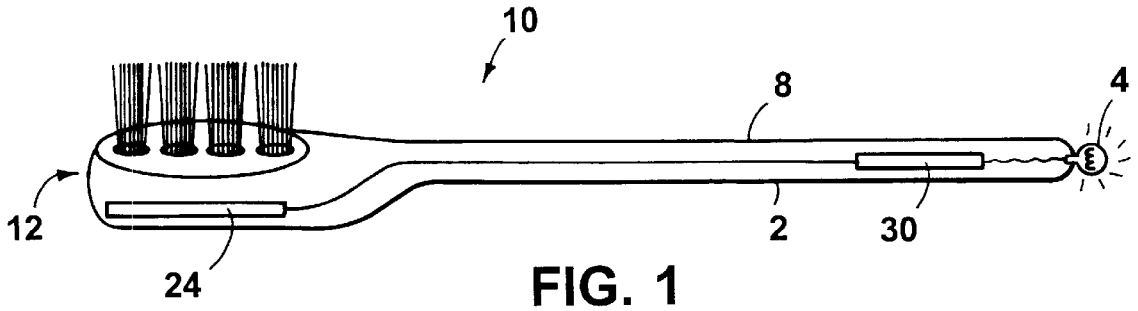
FIG. 1 is a schematic perspective view, in partial cross-section, of a toothbrush according to one embodiment of the invention.

Toothbrush 10 for sensing pressure applied during brushing and for indicating when the pressure exceeds a predetermined value is shown in partial cross-section in FIG. 1. Toothbrush 10 includes a piezoelectric film 24 disposed within brush head 12 and an indicator circuit 30, including signal element 4, disposed within handle 8.

Figure 2:
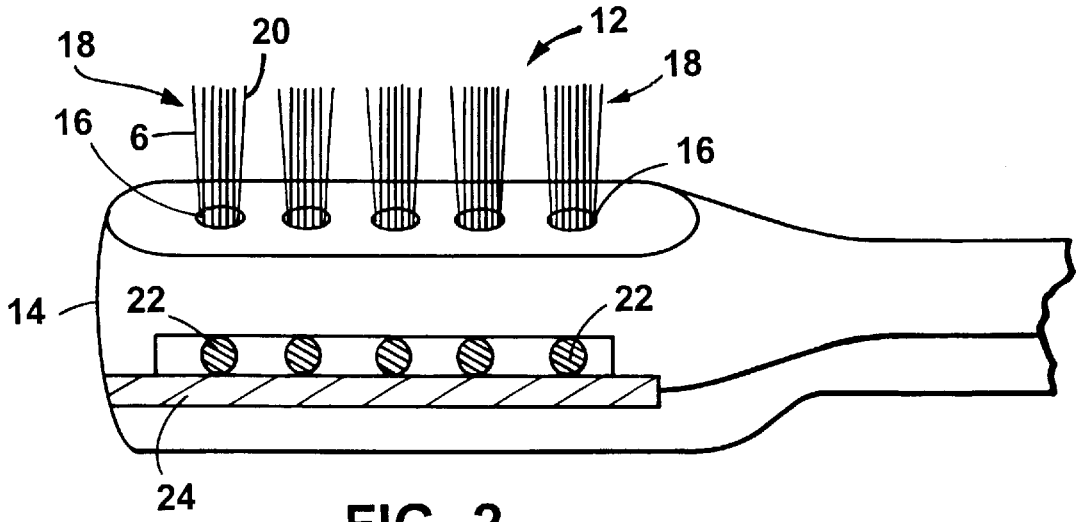
FIG. 2 is an enlarged detail view of a portion of the toothbrush shown in FIG. 1.

Referring to FIG. 2, an enlarged cross-sectional view of brush head 12 is shown. Tufts 18 of bristles 6 extend through openings 16 in member 14 of head 12. Each tuft has a crest end 20 extending outward from opening 16 and a root end 22 disposed beneath opening 16 in member 14. The length of bristles extending between crest end 20 and root end 22 of tuft 18 has a cross-sectional dimension that is less than the cross-sectional dimension of opening 16 so that tuft 18 can move axially through opening 16 and retract downwardly toward piezoelectric film 24. The cross-sectional dimension of root end 22 is greater than the cross-sectional dimension of opening 16, which inhibits root end 22 from passing through opening 16 and retains tuft 18 within head 12.

Piezoelectric film 24 is disposed within head 12 beneath root ends 22 of tufts 18 so that film 24 will experience strain when pressure is applied to tufts 18. When pressure is applied to tufts 18, root ends 22 are forced into contact with piezoelectric film 24. The pressure exerted by root ends 22 on film 24 causes a change in the strain of film 24, which causes film 24 to generate voltage. As is well known in the piezoelectric art, piezoelectric films carry a permanent dipole moment that, when the film is at rest, is cancelled out by charges in the atmosphere. Deforming the film, i.e., applying a force to the film that generates a strain, changes the orientation of the polymer backbone of the film, which causes the strength of the dipole to change and generates an electrical voltage. If the piezoelectric film comes to rest in its deformed position, i.e., the pressure applied is constant and no new strain is generated, the new dipole will again be cancelled out by atmospheric charges and the voltage will cease. As long as the orientation of the polymer is being changed by application of a varying degree of pressure to the film, voltage will be generated.

Figure 3:
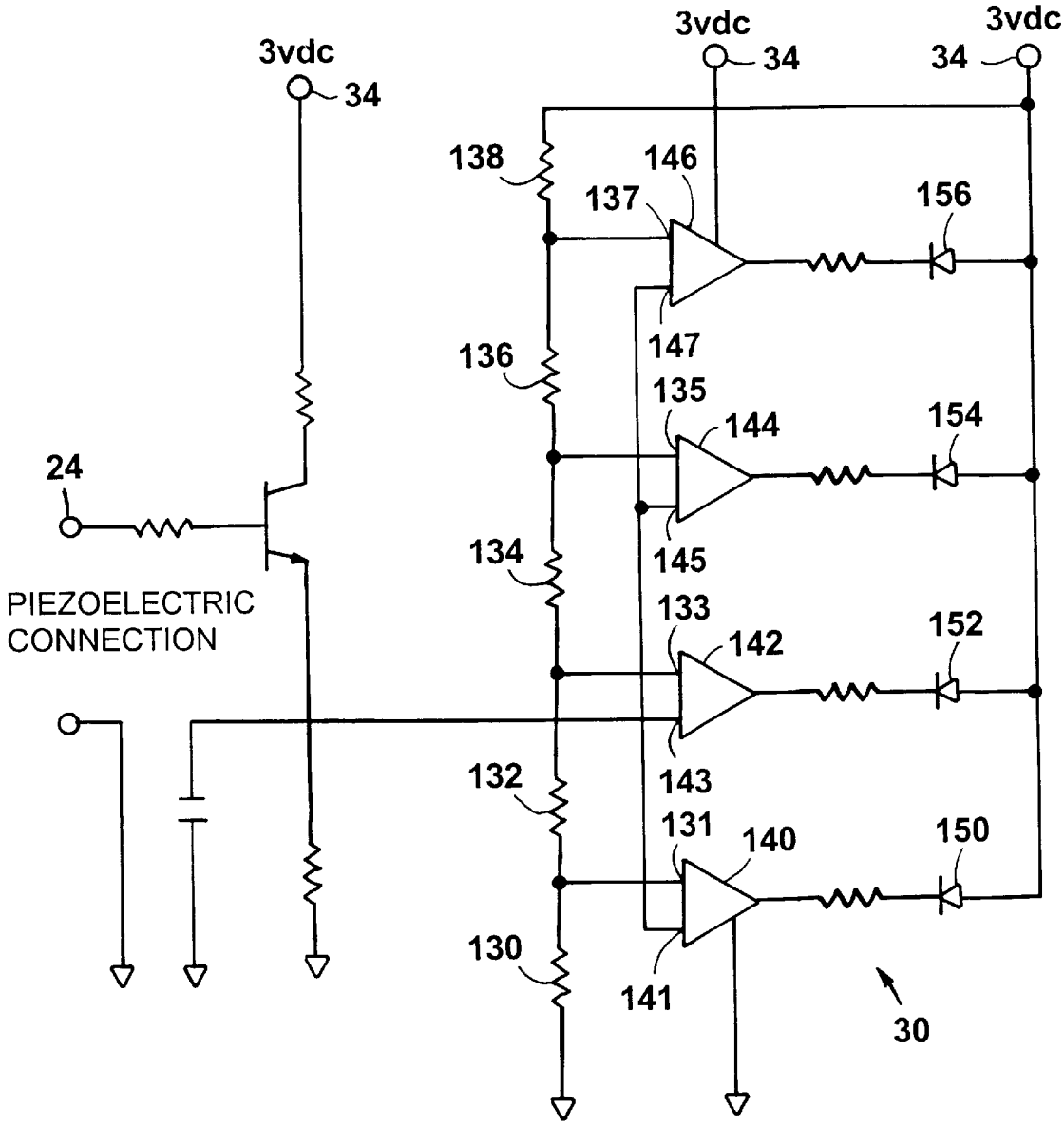
FIG. 3 is a schematic diagram showing a circuit according to one embodiment of the invention, suitable for use in the toothbrush of FIG. 1.

Referring to FIGS. 1 and 3, indicator circuit 30, located within the handle 8 of toothbrush 10, senses the voltage generated in piezoelectric film 24 and determines whether the voltage generated is greater than a predetermined value, e.g., a value that represents a level of brushing pressure or brushing velocity that will not harm surfaces of the mouth. If the voltage is greater than the predetermined value, a signal is provided to the user of the toothbrush. The signal may indicate, e.g., that the pressure being applied is too great or the brushing velocity is too fast. Any circuit capable of receiving a signal from the piezoelectric film, determining if the signal is greater than a predetermined value, and providing a signal perceivable by the user can be used as the indicator circuit. Such circuits can be readily constructed by those skilled in the art.

One example of a suitable indicator circuit is shown in FIG. 3. Indicator circuit 30 includes a power source 34, e.g., a battery, for providing power to the circuit including comparators 140, 142, 144 and 146 and diodes 150, 152, 154 and 156. The resistor divider network 128 causes the voltage applied to each reference input 137, 135, 133 and 131 of comparators 140, 142, 144 and 146 to differ. The voltage increases in value from input 131 to input 137 so that the voltage at input 137 is greater than the voltage at input 135, which is greater than the voltage at input 133, which is greater than the voltage at input 131. The output voltage from piezoelectric film 24, which corresponds to the brushing pressure, is simultaneously applied to variable inputs 141, 143, 145 and 147. When the output voltage from piezoelectric film at variable input 141 of comparator 140 is less than the reference voltage at input 131, the comparator will exist in the on state. Accordingly, the forward biased light emitting diode ("LED") 150 will remain off. When the voltage at input 141 exceeds the reference voltage at input 131, the comparator will turn off, allowing current to flow through LED 150, whereupon LED 150 will turn on. As the output voltage from piezoelectric film 24 gradually increases and exceeds the reference voltage applied to inputs 133, 135, and 137 respectively, the corresponding LEDs 152, 154 and 156 will turn on. As the output voltage from the piezoelectric film increases and decreases, the appropriate LEDs turn on and off.

The reference voltage at input 137 corresponds to the predetermined maximum acceptable brushing pressure. When the voltage applied to variable input 147 exceeds the reference voltage at input 137, the red LED 156 will light, thereby indicating to the user that too much pressure is being applied to the oral surface.

The signal element, e.g., an LED, of the indicator circuit is preferably located on the toothbrush in such a way that it can be perceived by the user while the toothbrush is being used, e.g., it is not covered by the user's mouth or hand during brushing. Preferably the LED is located at the end of handle 8 or on the back surface 2 of handle 8 so that the LED can be seen by the user when looking in a mirror.

Figure 4:
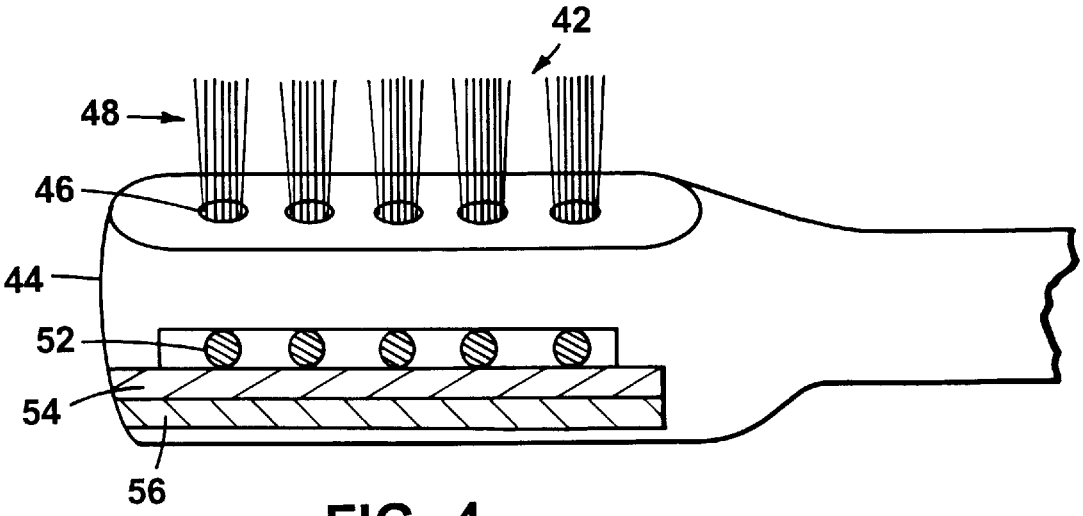
FIG. 4 is an enlarged detail view, in partial cross-section, of a toothbrush head according to an alternative embodiment of the invention.

Referring to FIG. 4, an alternate embodiment of toothbrush head 42 is shown in which a resiliently deformable membrane material 56 capable of resilient spot deformation, i.e, a membrane that has highly localized zones which can be resiliently displaced relative to the rest of the membrane without affecting the zones immediately adjacent to the displaced zone, is disposed beneath piezoelectric film 54. Such a membrane material is described, e.g., in U.S. Pat. No. 4,633,542 (Taravel), the disclosure of which is hereby incorporated herein by reference.

When the toothbrush is at rest, i.e., when no pressure is applied to tuft 48 urging it against piezoelectric film 54, membrane 56 is taut and resiliently biases root end 52 of tuft 48 against member 44. When pressure is applied to tuft 48, tuft 48 retracts into contact with piezoelectric film 54 by sliding through opening 46 and causing resilient spot deformation of membrane 56 at the point where tuft 48 is urged against piezoelectric film 54, without displacing the contact zones between the root ends of the respective immediately adjacent tufts and the membrane. Once the strain is released from the membrane, the membrane material regains its original structure. When the toothbrush is removed from the oral surface, i.e., the pressure is removed, tufts 48 return to their initial position with their respective root ends 52 abutting against member 44 by virtue of resilient membrane 56 returning to its initial position. Membrane 56 is preferably under tension since tension facilitates this spot deformation.

Membrane 56 is preferably formed from an isotropic elastomeric material selected for its ability to behave anisotropically in that it gives the membrane the property of being able to exhibit resilient deformation in localized spots. The choice of material for the membrane and the appropriate thickness are readily determined by the person skilled in the art as a function of the mechanical characteristics and, in particular, the elasticity required for the membrane. Suitable membrane materials include, e.g, natural or synthetic latex type elastomers (e.g., polychloroprenes), natural rubber, and silicones.

The thickness of the membrane in the relaxed state will generally vary in the range of 0.10 mm to less than 1 mm. Such a thickness will enable localized or spot resilient deformation with an amplitude of 0.5 mm to 5 mm for a force of about 1 Newton (N) to 7.5 N (i.e., about 150 grams-force to about 750 gf) applied in a distributed manner over the set of tufts of bristles.

Figure 5:
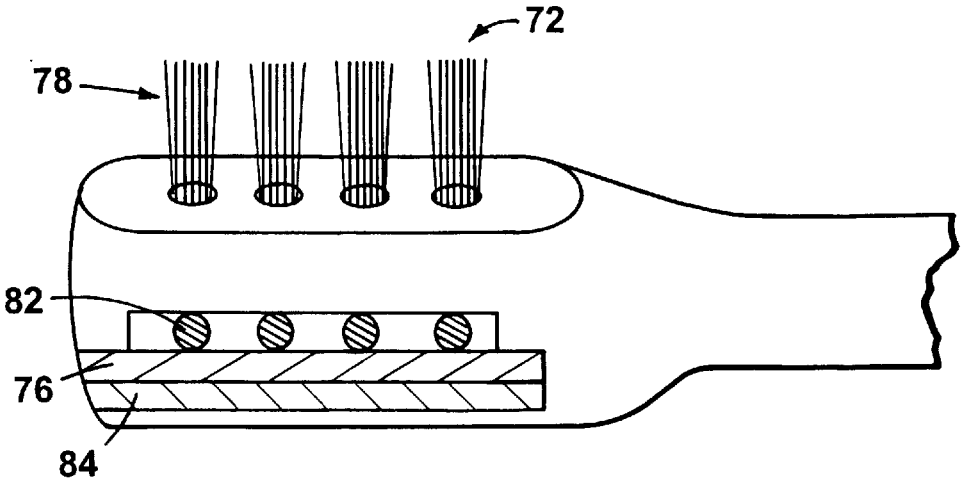
FIG. 5 is an enlarged detail view, in partial cross-section, of a toothbrush head according to an alternative embodiment of the invention.

Alternatively, membrane 76 may be disposed above piezoelectric film 84 between root ends 82 of tufts 78 and piezoelectric film 84, as shown in FIG. 5.

Figure 6:
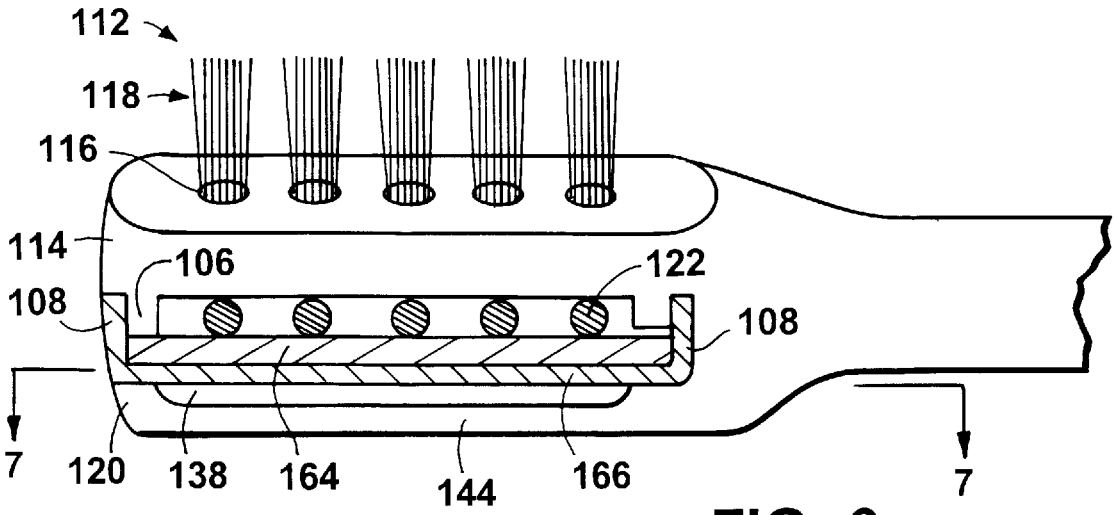
FIG. 6 is an enlarged detail view, in partial cross-section, of a toothbrush head according to an alternative embodiment of the invention.

Referring to FIG. 6, in another embodiment, membrane 166 extends across a cavity 138 defined by member 144 in head 112 so as to seal cavity 138. The toothbrush also includes piezoelectric film 164. During assembly of the toothbrush membrane 166 is fixed, while taut, to head 112 at the periphery of cavity 138. Cavity 138 and membrane 166 enclose a cushion of air, the presence of which facilitates vertical spot deformation of membrane 166 in response to axial retraction of a tuft of bristles. Member 114, which is made of rigid material, e.g., a plastic material, like the remainder of the brush head, is fixed to the brush head and together therewith clamps the membrane in continuous manner all around the periphery of cavity 138. Member 114 may be a separate piece forming a rigid extension of the head or may be integrally molded with the head.

Figure 7:
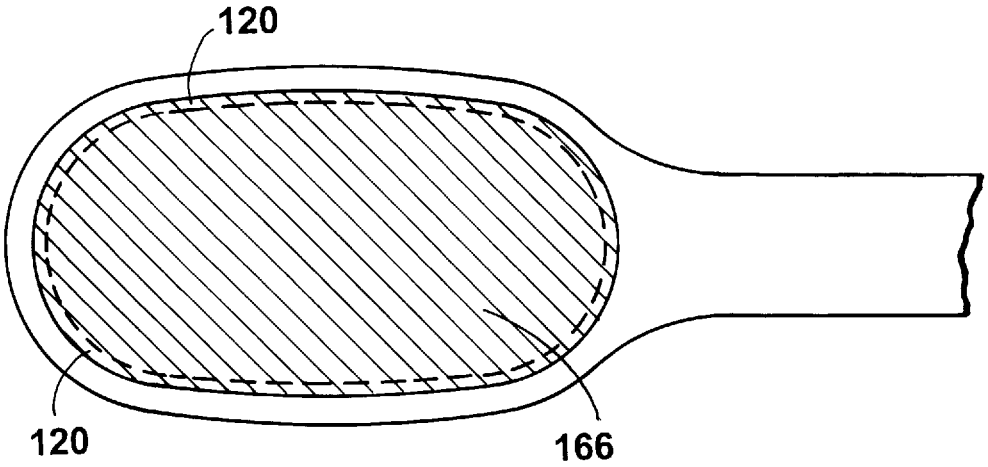
FIG. 7 is a detail view of the toothbrush head of FIG. 6 taken along 7—7.

A continuous rim 106 projects substantially perpendicularly from an area near the perimeter of member 114. A continuous peripheral zone 108 of membrane 166 is clamped between the side of head 112 and rim 106 thereby fixing membrane 166 to the head and ensuring that membrane 166, member 114 and head 112 are fixed relative to one another. In addition or alternatively, membrane 166 may be affixed to rim 120 around the edge of cavity 138, e.g., by glue or a heat weld, as shown in FIG. 7.

Any method may be used to fix the periphery of the membrane to member 114 or rim 120, provided the portion of the membrane that contacts the root ends 122 of tufts 118 remains resiliently deformable. Tufts 122 retract into and are biased by membrane 166 in the same manner as discussed above with reference to FIGS. 4 and 5.

Other embodiments are within the claims and include, for example, an embodiment in which the piezoelectric film extends across a cavity, e.g., the cavity shown in FIG. 6, in the absence of a membrane. In another embodiment, the indicator circuit is located external to the toothbrush.

Figure 8:
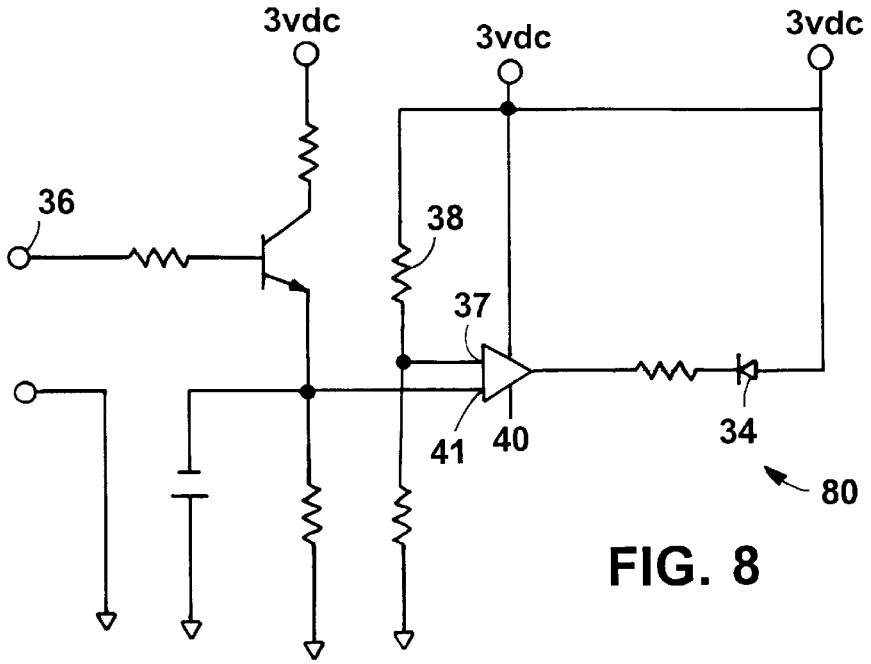
FIG. 8 is a schematic diagram showing a circuit according to an alternative embodiment of the invention.

In one alternate embodiment, the voltage generated in piezoelectric film is transferred via lead 36 to an indicator circuit 80 that includes comparator 40 and a single LED 34 as shown in FIG. 8. LED 34 turns on when the output voltage from the piezoelectric film (applied to variable input 41 of comparator 40) exceeds the voltage drop across resistor 38 as applied to reference input 37 of comparator 40. Alternatively, the LED is bicolored, e.g., red and green, and the circuit is constructed to turn on one portion of the LED, e.g., the green portion, when the brushing pressure is less than a predetermined value, and to turn on another portion of the LED, e.g., the red portion, when the brushing pressure exceeds a predetermined value.

In some embodiments, the toothbrush includes an indicator circuit constructed to provide a signal in the form of a pleasant sound, a musical riff or an intriguing light display, which may encourage the user to continue brushing. The pleasant sound or music may be generated by a sound or music generating device such as, e.g., speakers and musical integrated circuits. The light display may include a plurality of colored LEDs or bicolored LEDs. The circuit turns on the signal element, e.g., the light display or the sound device, when an acceptable brushing pressure is applied to the oral surface and turns the signal element off when the pressure exceeds a predetermined value. The circuit may also be constructed with a timing device to turn the signal element off after a predetermined length of time. Such a circuit would aid a user in brushing for a period of time sufficient to clean the oral surfaces.

What is claimed is:

1. A toothbrush comprising:

a head;

a tuft of bristles positioned at said head;

a piezoelectric film disposed within said head in such a way that a force applied to said tuft of bristles generates voltage in said piezoelectric film; and an indicator for indicating that a predetermined level of voltage is being generated in said piezoelectric film.

2. The toothbrush of claim 1, wherein said piezoelectric film is disposed beneath said tuft of bristles.

3. The toothbrush of claim 1, wherein said tuft of bristles is capable of retracting axially into said head when said force is applied to said tuft of bristles.

4. The toothbrush of claim 3, wherein said head further comprises an opening and said tuft of bristles is axially moveable through said opening.

5. The toothbrush of claim 4, further comprising a membrane disposed beneath said tuft of bristles for inhibiting axial movement of said tuft of bristles through said opening in the absence of a force being applied to said tuft of bristles.

6. The toothbrush of claim 1, further comprising a membrane disposed between said tuft of bristles and said piezoelectric film.

7. The toothbrush of claim 6, wherein said membrane is resiliently deformable.

8. The toothbrush of claim 6, wherein said membrane is capable of spot deformation.

9. The toothbrush of claim 1, wherein said head is constructed to permit said tuft of bristles to contact said piezoelectric film when said force is applied to said tuft of bristles.

10. The toothbrush of claim 1, wherein said indicator is constructed to provide a visible signal.

11. The toothbrush of claim 1, wherein said indicator is constructed to provide an audible signal.

12. The toothbrush of claim 1, wherein said indicator is disposed within said toothbrush.

13. The toothbrush of claim 1, wherein said indicator comprises an LED.

14. The toothbrush of claim 1, wherein said indicator comprises a plurality of LEDs.

15. The toothbrush of claim 1, wherein said indicator comprises a musical integrated circuit.

16. The toothbrush of claim 1, further comprising a plurality of tufts of bristles positioned at said head.

17. The toothbrush of claim 1, further comprising a cavity located within said head to permit movement of said tuft of bristles into said head.

18. The toothbrush of claim 17 further comprising a membrane extending across said cavity.

19. The toothbrush of claim 18, further comprising a cushion of air sealed within the space defined by said membrane and said cavity.

20. The toothbrush of claim 1, wherein said indicator comprises:

a comparator device for comparing said predetermined level of voltage with said voltage generated in said piezoelectric film; and a signal element responsive to said comparator device, for signaling when said voltage generated in said piezoelectric film is greater than said predetermined level of voltage.

21. The toothbrush of claim 20, wherein said signal element is an LED.

22. The toothbrush of claim 20, wherein said signal element is a plurality of LEDs.

23. The toothbrush of claim 20, wherein said signal element is a musical integrated circuit.

24. A method for cleaning an oral surface, said method comprising:

providing a toothbrush comprising a head, a tuft of bristles positioned at said head, a piezoelectric film disposed within said head in such a way that a force applied to said tuft of bristles generates voltage in said piezoelectric film, and an indicator for indicating that a predetermined level of voltage is being generated in said piezoelectric film; and brushing an oral surface with said toothbrush.

* * * * *